United States Patent [19]

Tassoni

[11] 4,227,307

[45] Oct. 14, 1980

[54] APPARATUS FOR SCRIBING WALL PANELS

[76] Inventor: Robert Tassoni, 5 Rosewood Dr., Greenville, R.I. 02828

[21] Appl. No.: 13,791

[22] Filed: Feb. 21, 1979

[51] Int. Cl.[3] ..... B43L 13/02

[52] U.S. Cl. ..... 33/41 F; 33/42; 33/180 R

[58] Field of Search ..... 33/41, 42, 180 R, 187, 33/411; 269/43, 152, 154; 52/546–547, 416

[56] References Cited

U.S. PATENT DOCUMENTS

| | | | |
|---|---|---|---|
| 338,156 | 3/1886 | Johnson | 33/187 |
| 571,374 | 11/1896 | Kerr | 33/187 X |
| 1,574,099 | 2/1926 | Kridler | 52/547 |
| 2,511,083 | 6/1950 | Small | 52/547 |
| 3,516,167 | 6/1970 | McCain | 33/41 F |

FOREIGN PATENT DOCUMENTS

| | | | |
|---|---|---|---|
| 217302 | 11/1967 | Sweden | 52/547 |
| 160906 | 3/1921 | United Kingdom | 52/547 |

*Primary Examiner*—Harry N. Haroian
*Attorney, Agent, or Firm*—Salter & Michaelson

[57] ABSTRACT

Apparatus including jig means and associated scribing means for scribing a wall panel for insertion into a wall area bounded on one side thereof by an already mounted wall panel and on the other side by a wall corner. The jig means is preferably of overall S-shaped configuration and includes a pair of oppositely disposed open ended slots, one of which receives therein the proximal edge of the already mounted wall panel. The base portions or inner ends of the slots overlap so as to be disposed a predetermined distance apart from each other, such that the roughly sized wall panel to be scribed may be disposed in the other slot so that the panel to be mounted overlaps the already mounted wall panel a distance equal to said predetermined distance. The scribing means includes a reference line follower and a scriber spaced apart from each other said predetermined distance such that a trim line may be scribed said predetermined distance inwardly from the other end of the panel to be mounted. Means are provided for releasably clamping the panels to the jig means as well as for enabling a flange portion of one of the slots to be disposed behind the already mounted wall panel.

7 Claims, 7 Drawing Figures

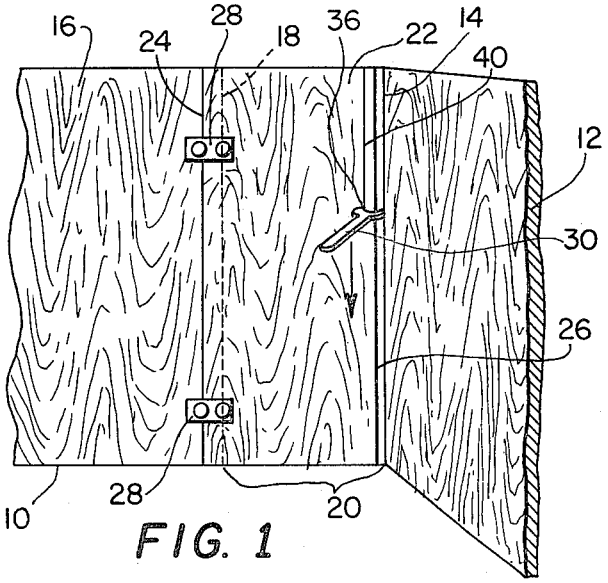
FIG. 1
FIG. 2
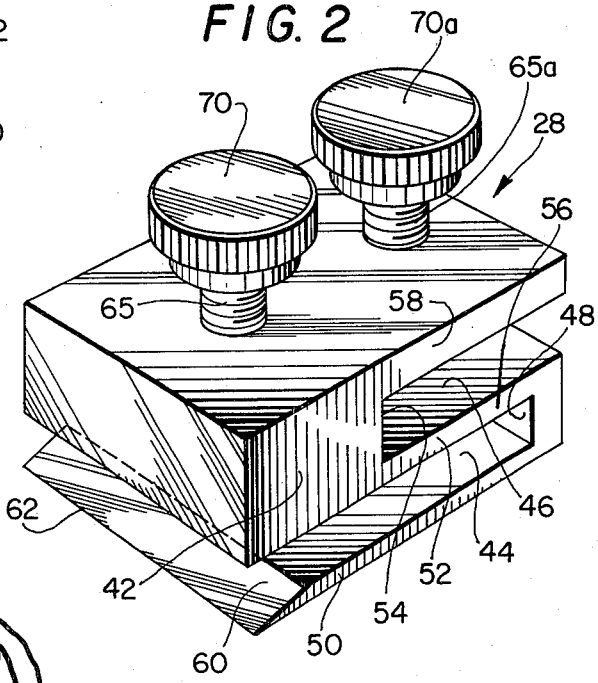
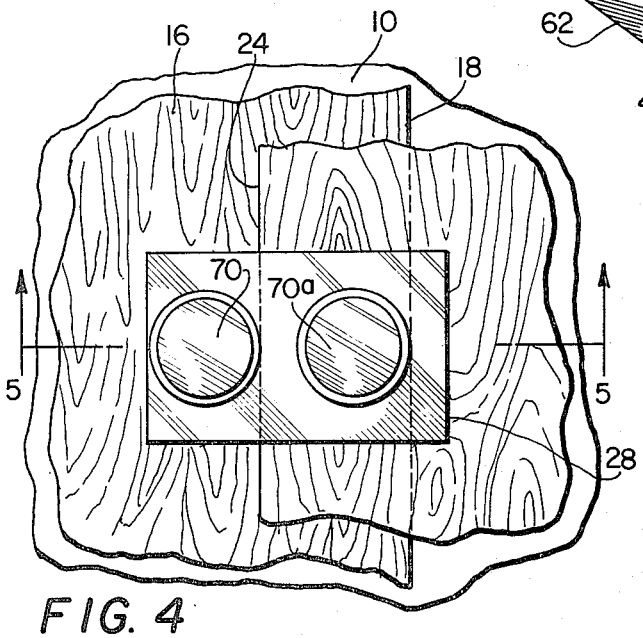
FIG. 4
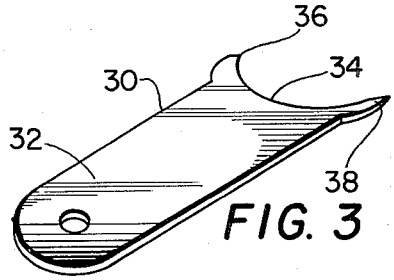
FIG. 3
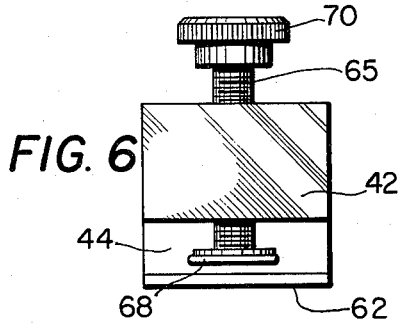
FIG. 6
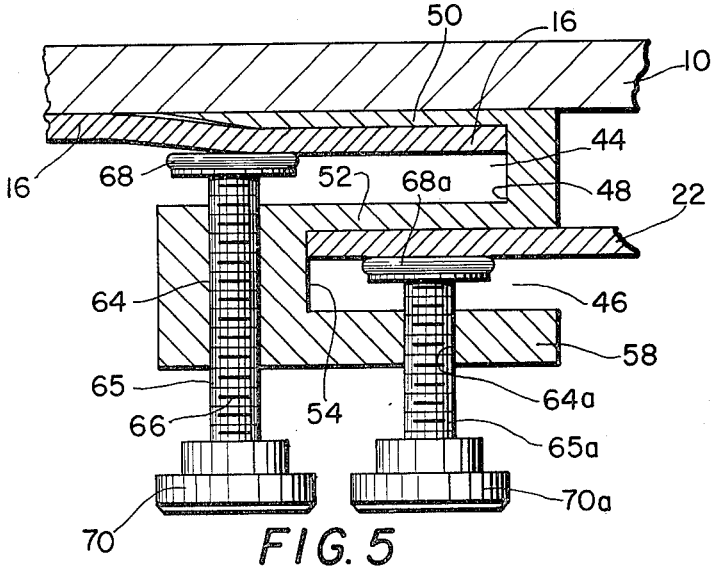
FIG. 5
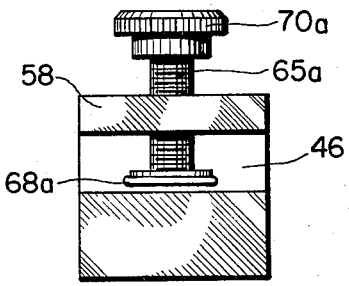
FIG. 7

APPARATUS FOR SCRIBING WALL PANELS

BACKGROUND AND SUMMARY OF THE INVENTION

The present invention relates generally to panel scribing apparatus and more particularly to a novel device or tool for accurately scribing panels to be installed between first and second generally laterally spaced reference lines. Accordingly, the apparatus has particular utility in scribing panels to be installed at both inside and outside wall corners. Wall corners are seldom exactly in line, and accordingly a problem is presented to correctly cut that edge portion of a wall panel adapted for disposition proximate to an angularly disposed adjacent wall such that there will be a snug fit therebetween. For example: in covering walls with standard size decorative wall panels or sheets, one usually starts at the center of a wall and mounts full size panels adjacent one another progressively towards the opposite corners until the space remaining between the last full panel and the corner is less than a full panel width. A partial panel is then trimmed to fit the existing corner. Generally this fitting and trimming has been done on more or less a cut and try basis which is time-consuming and often wasteful of material, especially to homeowners or other do-it-yourselfers having less experience than professional wall panel installers.

A device helpful in such installations is disclosed in U.S. Pat. No. 3,516,167 issued June 23, 1970 wherein a jig and scribing tool are provided for such purpose. Specifically, the jig 10 thereof is tacked or nailed in position with respect to the free edge of the already mounted wall panel. Referring to FIG. 4 of this patent, it may be seen that the mounted panel 56 butts up against the surface 16 of the jig and then the jig is nailed to the wall 72. The panel 66 to be scribed is then slidably inserted into the recess of the jig until it engages surface 18 and then the opposite end of the panel 66 is scribed by the member 28 as by following the contour of the adjacent wall. While a decided improvement over previous cut and try trimming techniques, the above-disclosed device presents several problems in use including its necessity of being nailed to the wall plus being somewhat awkward to manipulate inasmuch as during the scribing process the wall panel to be mounted is not securely held by the jig or fixture at that time. The above citation and prior art discussion constitutes applicant's Prior Art Statement and in that regard, a copy of the aforementioned patent is enclosed with this application.

It is accordingly an object of the present invention to provide a novel apparatus of the aforementioned type including jig means which can be firmly and releasably engaged between proximal portions of an already mounted panel and a panel to be mounted adjacent thereto.

A further object of the present invention is the provision of a novel jig means of the aforementioned type which may be easily, quickly and positively positioned with respect to both the already mounted panel and the panel to be mounted.

These and other objects of the present invention are accomplished by the provision of apparatus including jig means and scribing means in which the jig means is of an overall generally S-shaped configuration so as to present first and second open ended longitudinally orientated slots adapted to receive the proximal edge of a first already mounted wall panel and the adjacent first edge of a second panel to be mounted, wherein the base walls in part defining said slots are longitudinally spaced apart from each other a predetermined distance corresponding to the distance between the reference line follower and scriber portions of the scribing means usable to simultaneously follow the contour of the wall corner and scribe a trim line on the panel to be mounted.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a perspective view showing a room corner in order to illustrate the manner in which the present invention is utilized;

FIG. 2 is a perspective view of the jig means of the present invention;

FIG. 3 is a perspective view of the scribing means of the present invention;

FIG. 4 is an enlarged elevational view of a portion of FIG. 1 showing the manner in which the jig means is mounted between respective wall panels;

FIG. 5 is a sectional view taken on the line 5—5 of FIG. 4;

FIG. 6 is an end view of FIG. 5 when viewed from the left of FIG. 5; and FIG. 7 is a view similar to FIG. 6 but taken from the right side of FIG. 5.

DESCRIPTION OF THE DRAWING

Turning now to the drawing and particularly FIG. 1 thereof, the manner in which the apparatus of the present invention is intended for use is best shown. Therein, the adjacent walls 10 and 12 of a room are shown with wall 10 to be covered with wall panels. Such walls intersect in a corner 14 which, as often is the case in actual construction, may be of somewhat irregular contour. Additionally, wall 12 may represent some other surface which angularly extends from wall 10, such as a fireplace, bookshelf, etc.

When mounting the wall panels upon such walls, it is customary to initially utilize the approximate wall center as a starting point. Following such procedure, a plumb line may be made at such approximate center of the wall and used as the starting point from which to work towards each corner. A first wall panel 16 having been already mounted on the wall 10 as by such procedure is shown in FIG. 1. Obviously, other procedures may, however, be utilized. Such already mounted panel or panels 16 presents a free edge 18 which with the corner 14 define a wall area 20 therebetween which is of a lateral extent less than that of a full panel. A rough cut second panel 22 is then positioned such that its first edge 24 overlaps the first panel 16 a predetermined distance and, its rough cut or opposite edge 26 is positioned somewhat adjacent to the corner line 14. Such positioning is accomplished by a pair of jigs or fixtures 28 made in accordance with the present invention and the construction of which will be hereinafter more fully brought out.

The scribing tool 30 includes an elongated handle 32 which terminates at one end thereof in an enlarged generally cresent-shaped head 34 which in turn defines a pair of points 36 and 38 laterally spaced apart such predetermined distance from each other. One of the points 36 serves as a scribing means and the other point 38 serves as a reference line follower, i.e. adapted to follow the irregularities of the wall corner 14 so as to enable such irregularities to be exactly duplicated by the scribe mark 40 formed by the point 36, which, because of the spacing between the points 36, 38 will be inwardly displaced from the corner line 14 by such predetermined dimension. Thereafter, when the second panel is cut along the scribe line 40, the edge formed thereby will exactly fit the irregularities of the corner 14 and the remaining portions of the panel 22 will substantially exactly conform to the wall area 20 to be covered thereby. This method removes much of the time-consuming guess work normally associated with prior art methods and enables wall panels to be properly fitted to irregular surfaces without needless wasted material.

Turning now in particular to FIG. 2 of the drawing, the construction of the jig 28 which enables the aforementioned overlapped positioning of the second panel 22 with respect to the first panel 16 in a convenient and positive manner, will be seen. The jig is of overall S-shaped configuration and includes a body portion 42. The jig 28 further includes a pair of open ended slots including a first slot 44 and a second slot 46. The first slot 44 includes a base wall 48, an inner side wall 50 and an outer sidewall 52. Similarly, the outer slot 46 includes a base wall 54, an inner sidewall 56 and an outer sidewall 58. The inner sidewall 56 of the outer slot 46 and the outer sidewall 52 of the inner slot 44 comprise a common member in part forming the overall S-shaped configuration of the jig 28. The longitudinal slot displacement, that is, the spacing between the base walls 48 and 54 corresponds to the predetermined distance between the points 36, 38 of the scribing means 30.

The inner sidewall 50 in effect forms a flange and its terminal end 60 is tapered so as to form a relatively sharp edge 62. The flange is accordingly adapted for slidable disposition behind a portion of the already mounted first panel 16 such that the edge 18 thereof abuts with the base wall 48. Similarly, a first edge 24 of the second panel 22 is adapted for disposition in the outer slot 46 and in abutment with the base wall 54 thereof. It is accordingly seen that by positioning one or more, and generally a pair of jigs 28, in the manner as shown in FIG. 1 of the drawing, that the panels 16, 22 will be disposed in overlapping relationship to an extent defined by the predetermined distance between the base walls 48 and 54.

In order to positively mount the jigs 28 upon the already mounted panel 16, the body 42 is provided with a laterally extending threaded bore 64 adapted to receive a clamping device 65 having a threaded member 66 in turn including a flat head 68 adapted to engage a portion of the panel 16 that is disposed between such head and the flange 50 disposed therebehind. The other end of the threaded member 66 is provided with a knurled head 70 such that the member 66 may be hand-manipulated and in that regard, serves, when tightened, to positively secure and, when loosened, to easily release the jig 28 from its position upon the first panel 16. Thereafter, the first edge 24 of the second panel 22 may be slipped within the outer slot 46 as by temporarily giving the second panel 22 a slight inward or outward bow to shorten the lateral dimensions thereof. Once so positioned within the outer slot 46, a second panel 22 may be securely clamped by means of a second clamping device **65*a* similar in construction to the clamping device 65 but adapted to threadably engage a bore 64*a* provided within the outer sidewall 58 of the outer slot 46**.

The end 26 of the panel 22 is then scribed, as aforesaid, by the scriber 30, it being understood that the scribe line 40 will faithfully follow the contour of corner 14, and that the panel 22, as defined by edge 24 and scribe line 40 will snugly fit within the space 20.

While there is shown and described herein certain specific structure embodying the invention, it will be manifest to those skilled in the art that various modifications and rearrangements of the parts may be made without departing from the spirit and scope of the underlying inventive concept, and that the same is not limited to the particular forms herein shown and described except insofar as indicated by the scope of the appended claims.

What is claimed is:

1. In an apparatus for scribing a rough sized second wall panel for insertion into a wall area defined by a first reference line formed by the proximal edge of an already mounted first wall panel and a second reference line spaced therefrom, including jig means for positioning said second panel relative to said wall section such that a first edge thereof is in overlapping relationship with and spaced a predetermined distance from said first reference line and the opposite edge of said second panel is positioned proximal to said second reference line; and scribing means including a reference line follower and a scriber spaced said predetermined distance therefrom for scribing a trim line corresponding to said second reference line along said second panel at a position inwardly spaced from the opposite edge thereof a distance generally equal to said predetermined distance such that the shape of the area of said second panel between said first edge and said trim line is substantially equal to the shape of the said wall area; the improvement comprising, jig means having a generally S-shaped body, first and second open ended longitudinally oriented generally U-shaped slots adapted to receive said proximal edge of said first panel and said first edge of said second panel respectively therein, said slots respectively opening on opposite sides of said jig body, each said slot including a base wall defining the longitudinal extent thereof with said base walls longitudinally spaced said predetermined distance apart from each other, said panel edges received in said slots adapted to abut said base walls, said slots further including opposed inner and outer sidewalls longitudinally extending from respective base walls thereof, the inner sidewall of said first slot forming a flange in turn forming the lower run of said generally S-shaped body, said flange adapted to extend behind said first panel and in contact with both said first panel and said wall, first holding means adapted to extend onto said first slot for releasably and securely holding said first panel in said first slot and second holding means adapted to extend into said second slot to releasably and securely hold said second panel in said second slot said first and second holding means extending into said first and second slots from the same side of said S-shaped body.

2. The apparatus of claim 1, said first slot outer sidewall and said second slot inner sidewall being a common wall.

3. The apparatus of claim 2, said first and second holding means each having one end thereof adapted to respectively engage said panels, said holding means being mounted in said outer slot sidewalls so as to force said panels respectively against said inner slot sidewalls.

4. The apparatus of claim 3, said first and second holding means each being a screw clamp and said first slot clamp threadably received through said jig means body.

5. The apparatus of claim 3, the other end of said screw clamps having means for hand engaging said clamps for transverse relative movement with respect to said slots.

6. The apparatus of claim 1, said flange having a terminal knife edge.

7. The apparatus of claim 1 wherein the edges of both side first and second slots are also open.

* * * * *